US005459950A

United States Patent [19]

Damm et al.

[11] Patent Number: 5,459,950

[45] Date of Patent: Oct. 24, 1995

[54] COLLAPSIBLE SNOWSHOE WITH A PIVOTING BINDING

[76] Inventors: Stephen E. Damm, 0080 Ponderosa Cir., Glenwood Springs, Colo. 81601; Mack M. Hoover, 15 Crystal Cir., Carbonadale, Colo. 81623

[21] Appl. No.: 305,047

[22] Filed: Sep. 13, 1994

[51] Int. Cl.[6] ..... A43B 5/04

[52] U.S. Cl. ..... 36/122; 36/123; 36/125

[58] Field of Search ..... 36/122–125, 113–116

[56] References Cited

U.S. PATENT DOCUMENTS

| | | | |
|---|---|---|---|
| 405,516 | 6/1889 | Watson | 36/122 |
| 2,693,038 | 11/1954 | Wincentsen et al. | 36/4.5 |
| 3,555,707 | 1/1971 | Sharratt et al. | 36/4.5 |
| 3,599,352 | 8/1971 | Novak | 36/4.5 |
| 3,636,643 | 1/1972 | Lundquist | 36/4.5 |
| 4,041,621 | 8/1977 | Anderson | 36/122 |
| 4,203,236 | 5/1980 | Erickson et al. | 36/123 |
| 4,348,823 | 9/1982 | Knapp et al. | 36/123 |
| 4,604,817 | 8/1986 | Ramboz | 36/125 |
| 4,720,927 | 1/1988 | Abegg | 36/122 |
| 5,014,450 | 5/1991 | McGrath | 36/122 |

*Primary Examiner*—Paul T. Sewell
*Assistant Examiner*—Thomas P. Hilliard
*Attorney, Agent, or Firm*—Kyle W. Rost

[57] ABSTRACT

A collapsible snowshoe is constructed of an elongated frame having right and left side bars and front and rear end bars. A web extends between the end bars of the frame. A shoe binding is attached to the frame above the web and between the right and left side bars for pivotal motion along a transverse pivot axis. A resilient member urges relative pivotal motion between the shoe binding and the frame along the transverse pivot axis, causing the front of the frame to be urged upwardly with respect to the shoe binding.

12 Claims, 3 Drawing Sheets

COLLAPSIBLE SNOWSHOE WITH A PIVOTING BINDING

TECHNICAL FIELD

The invention generally relates to boots and shoes. More specifically, the invention relates to athletic shoes for walking on shifting media. In particular, the invention is a snowshoe that is foldable or collapsible, with a binding permitting the foot to pivot.

BACKGROUND ART

By distributing the wearer's weight over a large surface area, snowshoes permit a person to travel over shifting media such as snow without sinking. A typical construction employs a perimeter frame closed by a web, with a central binding that attaches the snowshoe to the foot or shoe of the wearer. Because the purpose of the snowshoe is to distribute the wearer's weight over a broad area, snowshoes tend to be large. Often they are several feet in length and one or more feet in width.

Although the large size is desirable when the snowshoe is in use, it is prohibitive of carrying a snowshoe in reserve capacity. In situations when a person might have to walk across deep snow, having a snowshoe in reserve is vitally important. For example, sportsmen on snowmobiles travel to remote areas having snow many feet deep. If the snowmobile should have a breakdown in a remote area, it might be impossible for a human on foot to walk to safety across the deep snow without the aid of snowshoes, skis, or the like. Similarly, any other traveller or sportsman in a snow covered area might find it essential to have snowshoes, whether due to breakdown, accident, change in weather, or unexpected conditions.

To better enable snowshoes to be carried in vehicles, on horseback, or in packs, many schemes have been developed to collapse or fold snowshoes. These schemes envision that the rigid frame can be collapsed by dissembling or folding. Collapsing the web presents little problem, since it is flexible and might be formed of swings, straps, or fabric sheet that can be folded or rolled into a compact package. However, reassembling a snowshoe presents a greater challenge. The frame must be assembled in a manner that it will be rigid, and the web must be attached to the frame to withstand the pressures of walking. The reassembly should be fairly quick and simple since this step is performed in the outdoors, often in severe weather and while gloves or mittens must be worn. Finally, the assembled snowshoe should perform in an acceptable way, similar to non-collapsible snowshoes, with a pivotal motion between the foot and the snowshoe.

The following patents show the state of the art in collapsible snowshoes. U.S. Pat. No. 3,555,707 to Sharratt et al teaches a snowshoe frame that can be folded once to half its initial length. When the hinge is opened in reassembly, a sheath telescopes over the hinge to provide rigidity during use. The binding is secured to two cross members of the frame and does not pivot, although the user is permitted to lift his heel. The lack of a toe pivot would cause this snowshoe to be difficult to use.

U.S. Pat. No. 4,348,823 to Knapp et al teaches an oval snowshoe frame that disassembles into three sections, reducing its length by two-thirds. For reassembly, the sections plug together and are secured by spring pins. In addition, an elastic cord runs through the oval frame so that all sections are strung together in proper order when disassembled and held in tension when assembled. The shoe binding appears to be a simple strap or bungee that could allow pivotal motion with the user's foot, although the resulting pivotal action is unreliable.

U.S. Pat. No. 3,636,643 to Lundquist teaches a threesection snow shoe that assembles by plugging together the frame sections. The assembled sections are held together by tension, created by stretching the web between the respective front and rear sections and the center section. The binding is a soft toe piece attached to a cross member of the center section. This binding would allow pivotal motion, although the pivoting action would be unreliable.

U.S. Pat. No. 4,203,236 to Erickson et al provides a snowshoe with tubular frame that folds on both longitudinal and lateral axes. When unfolded, internal plugs are pushed through the tubular members and across certain hinge areas. Other hinges are held open by a spreader plate that attaches transversely. There is no particular provision for a shoe binding, and it appears this snowshoe would be difficult to use due to lack of adequate pivoting action with the user's shoe.

U.S. Pat. No. 4,041,621 to Anderson teaches a snowshoe that is assembled from front and rear sections formed of hollow tubing, joined by being telescoped over a central rod received in the open end of each. Cross members lock the structure by plugging transversely through the sides of the respective front or rear tubes and the rod. Snowshoe webbing is strung on the frame to complete the structure. This patent deals with a method of permanent manufacture and not with a collapsible snowshoe that would be assembled at the point of use. There is not particular provision to enable a shoe binding to pivot with respect to the frame.

U.S. Pat. No. 3,599,352 to Novak et al teaches a collapsible snow shoe in which the frame is formed from steel rods. The rear section unplugs from sockets carried on the front rods. In addition, a cross brace folds in scissors fashion to allow the frame to collapse along a longitudinal axis. The shoe binding is an elastic cord wrapped on the user's foot, which would result in unreliable pivoting action between the foot and the snowshoe.

U.S. Pat. No. 4,720,927 to Abegg teaches a collapsible snowshoe in which the frame is formed of tubing sections joined by plug and socket connections. The web in this snow shoe is a fabric bag that encases the frame to hold it together but permits disassembly when the frame is removed from the bag. A toe binding is secured to the web and permits pivotal motion between the user's foot and the web.

The scope of this patent art shows a variety of assembly techniques that attempt to create a strong, rigid frame in an easily assembled, collapsible snowshoe. Yet, none of the prior art examples appears to have met all of the needs for a practical, reliable, easily assembled frame and snowshoe. In particular, it would be desirable for the frame to form a rigid configuration without requiring failure-prone components such as spring pins, sliding plugs or sliding sheaths.

Similarly, it would be desirable for such a reserve snowshoe to be extremely reliable in its pivotal action between the user's foot and the frame or web. Little attention appears to have been spent on this issue, which can be especially relevant in a snowshoe whose design is compromised to allow collapse, storage, carrying, and reassembly.

Further, it would be desirable for a collapsible snowshoe to require minimum assembly, and little or no careful or detailed work, since such assembly may be taking place under adverse weather conditions or difficult surroundings.

To achieve the foregoing and other objects and in accordance with the purpose of the present invention, as embodied and broadly described herein, the collapsible snowshoe of this invention may comprise the following.

DISCLOSURE OF INVENTION

Against the described background, it is therefore a general object of the invention to provide an improved collapsible snowshoe that does not require a heavy tail in order to cause the toe to raise with each step.

Another object is to provide a reserve snowshoe that has a rigid frame.

Still another object is to provide a collapsible snowshoe that is assembled quickly and easily, even under adverse weather conditions.

Additional objects, advantages and novel features of the invention shall be set forth in part in the description that follows, and in part will become apparent to those skilled in the art upon examination of the following or may be learned by the practice of the invention. The object and the advantages of the invention may be realized and attained by means of the instmmentalities and in combinations particularly pointed out in the appended claims.

According to the invention, a collapsible snowshoe is constructed of an elongated frame having right and left side bars and front and rear end bars. A web extends between the end bars of the frame. A shoe binding is attached to the frame above the web and between the right and left side bars for pivotal motion along a transverse pivot axis. A resilient member urges relative pivotal motion between the shoe binding and the frame along the transverse pivot axis, causing the front of the frame to be urged upwardly with respect to the shoe binding.

The accompanying drawings, which are incorporated in and form a part of the specification illustrate preferred embodiments of the present invention, and together with the description, serve to explain the principles of the invention. In the drawings:

BEST MODE FOR CARRYING OUT THE INVENTION

The invention is a collapsible snow shoe that is both compactly stored and easily assembled. The assembly employs a unique interaction between the components to produce an especially functional snowshoe. The assembled snowshoe has many favorable characteristics of full-size, non-collapsible snowshoes. Chief among these are a rigid frame and a pivoting motion between the foot binding and the frame, such that it is possible to walk long distances through loose snow.

Figure 1:
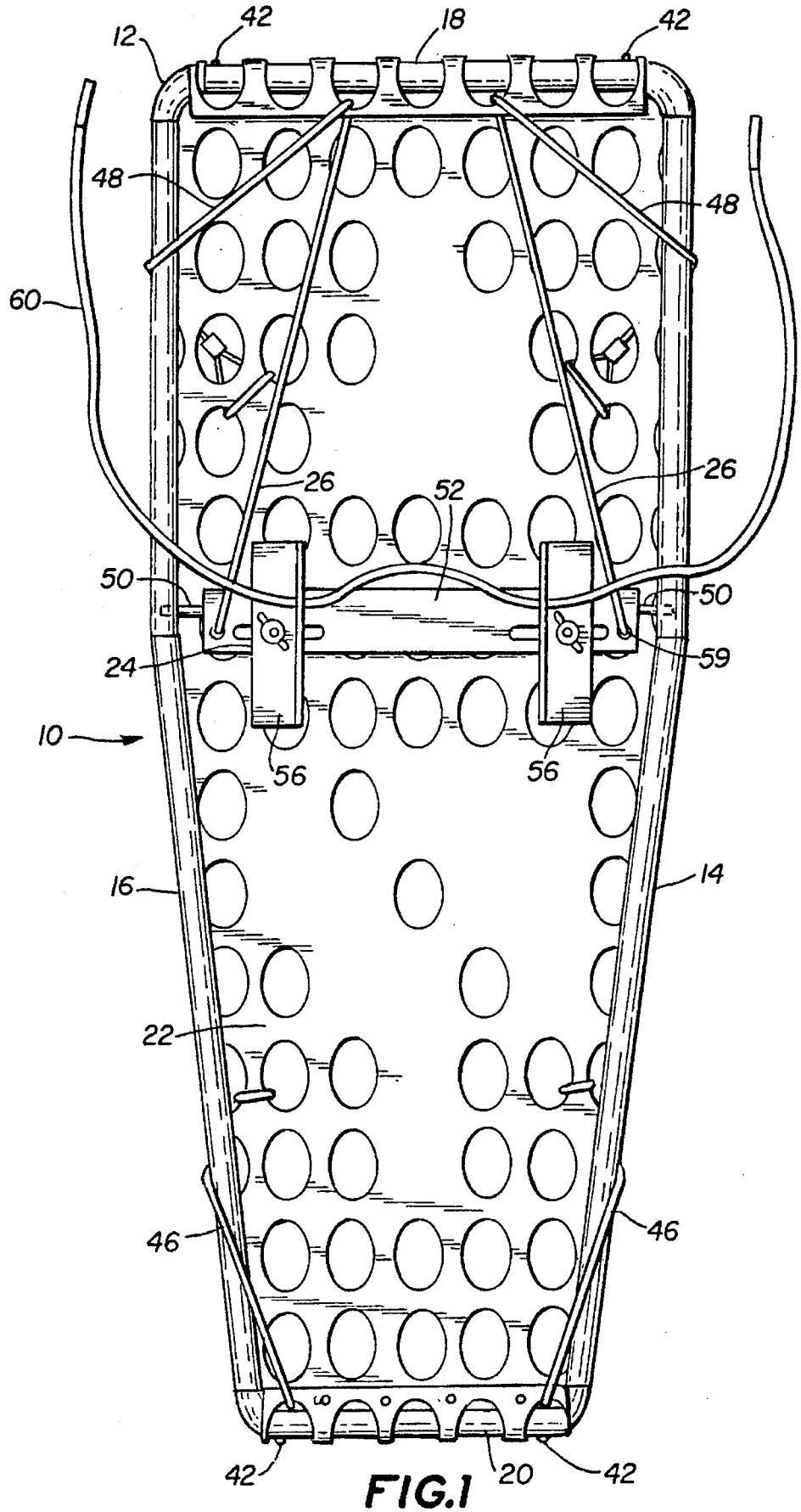
FIG. 1 is a top plan view of the snowshoe.

With reference to FIG. 1 of the drawings, the assembled snowshoe 10 has an elongated frame 12 of generally rectangular shape. The sides of the frame are defined by right side bar 14 and left side bar 16. The longitudinal ends are defined by a front end bar 18 and a rear end bar 20. All of these frame components are preferred to have hollow centers and, thus, are tubular in construction. This frame carries a web 22 substantially covering its underside. Thus, the web extends at least between the end bars of the frame and generally between the side bars. A shoe or foot binding 24 is attached to the frame above the web 22 and between the right and left side bars, which enables the snowshoe to be attached to a user's foot or to substantially any sort of footwear. This binding provides the important ability to pivot along a transverse pivot axis, allowing walking motion without requiring the rear of the snowshoe to raise along with the heel of the foot. Finally, the binding is linked to the remainder of the snowshoe by a resilient means 26 for urging relative pivotal motion between the binding and the frame along the transverse pivot axis. The resilient means 26 urges the front of the frame to pivot upwardly with respect to the binding, automatically raising the toe of the snowshoe whenever the foot is lifted. This automatic toe raising compliments the pivotal action of the binding. The combined result is that as the user walks in a comfortable manner, raising his heel at the conclusion of each step, the toe of the snowshoe is lifted as the foot starts its forward movement.

Figure 2:
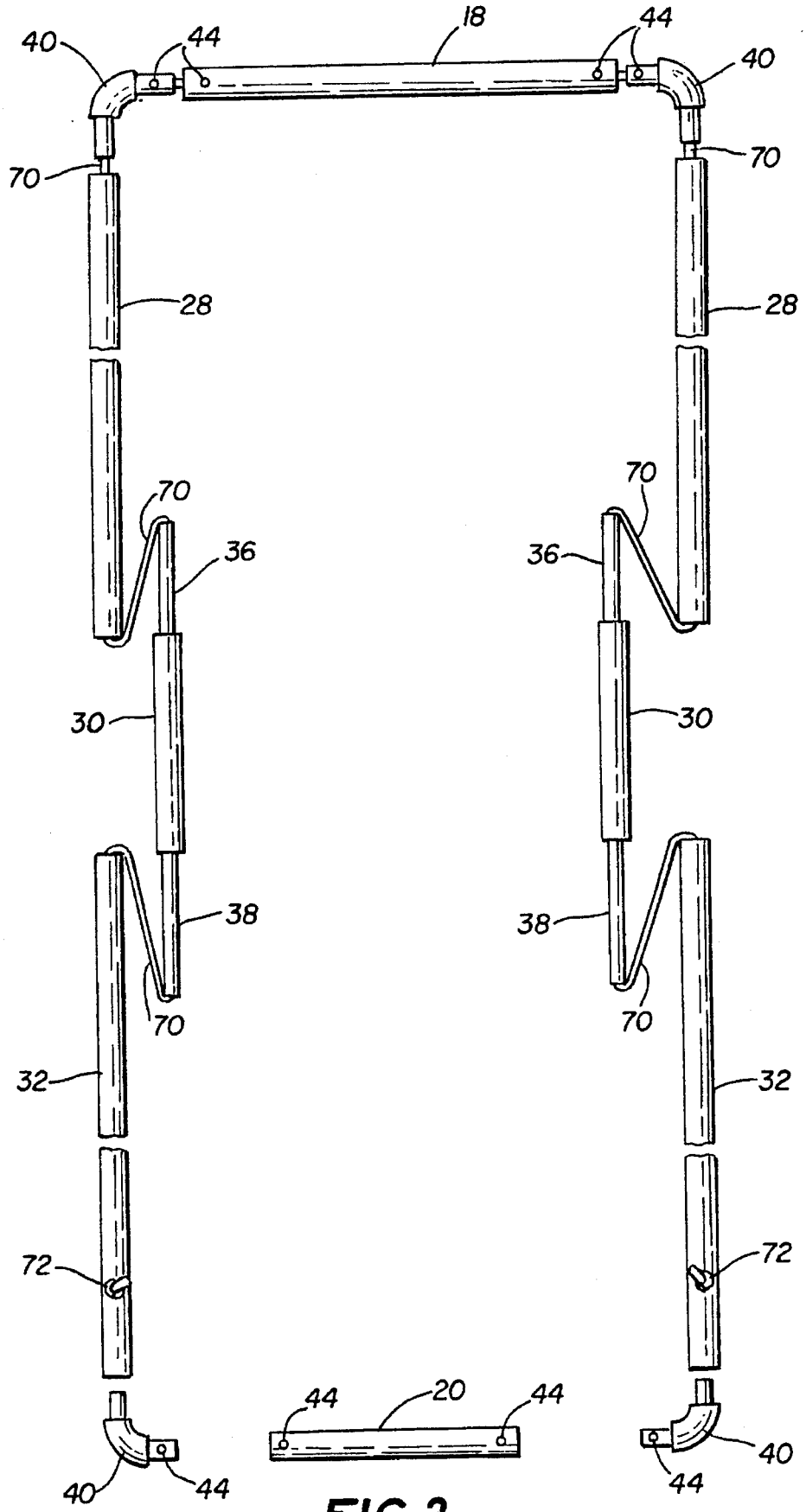
FIG. 2 is an exploded view of the frame.

The frame of the snowshoe is collapsible by disassembly. When assembled, the frame is rigid, which is desirable in order to provide a stable base for walking. FIG. 2 shows the components forming the perimeter. Each side bar of the frame is assembled from three tubes forming side bar sections, which are termed the front tube 28, the center tube 30, and the rear tube 32. These side bar sections are joined by plugging together telescoping ends. For example, center tube 30 carries an inner tube 34 sized to be received within any of the side bar sections. Tube 34 is fixed within tube 30, such as by a cotter pin or rivet passing through both tubes, and extends beyond both ends of tube 30. An equivalent alternative construction is to neck the opposite ends of tube 30, creating integral nipples. Either construction produces telescoping nipples or plugs that interconnect two juxtaposed side bar sections. The forward nipple or plug 36 serves as a first plug means for connecting the front to the center tube. The rear nipple or plug 38 serves as a second plug means for connecting the center to the rear tube. The side bar sections can be assembled or disassembled by, respectively, engaging and disengaging the tubes and the nipples or plugs.

The front and rear end bars of the frame carry angle connectors 40 that are joinable to the side bars. Each angle connector 40 is preferred to form a right angle and to terminate in nipples or plugs that are engageable in the end bars and side bars. The angle connectors may be integral with the end bars, or they may be fixed to the end bars by fasteners, such as cotter pins or rivets 42, FIG. 1, engaging mating holes 44 through the end bar and a first nipple of each angle connector. With respect to the front end bar 18, the second nipple serves as a third plug means disposed substantially at a right angle to the front end bar, for connecting the front end bar to the side bars. With respect to the rear end bar 20, the second nipple is a fourth plug means disposed substantially at a right angle to the rear end bar, for connecting the rear end bar to the side bars. Because the rear end bar 20 is shorter than the front end bar 18, it is necessary to flex the frame in order to engage the third and fourth plug means. Flexing the frame substantially eliminates the free play that otherwise may exist in the various tube connections and causes the entire frame to have increased rigidity.

With further reference to FIG. 1, web 22 is carried by frame 12 below the frame and in tension between the front and rear end bars. The rear end of the web is looped around the outside of the rear end bar 20 and secured to itself, such as by sewing, lacing, rivets, or other suitable fasteners. This attachment may be permanent, such that the rear end bar remains in the loop for storage even when the snowshoe is disassembled. The web is formed of flexible, planar sheet material, preferably formed of a synthetic plastic material, and defining an array of holes separated by a skeleton of border strips. These holes and border strips can be used to secure the web to the rear end bar, such as by tying border strips together to form the loop. Similarly, the front end of the web can be wrapped around the front end bar.

In order to tension the web on the frame, the sides and at least one end of the web are pulled by resilient members 26 such as elastic straps or cords, commonly known as bungee cords. As illustrated in FIG. 1 at the rear of the snowshoe, bungee cords 46 are fastened to the border strips of the web, routed upwardly around the outside of the frame, and fastened in tension to the frame or to the web, itself, such as by hooks. The bungee cords 46 place the web in lateral tension. A similar system of bungee cords can be used elsewhere on the snowshoe, as well. At the front end of the snowshoe, bungee cords 48 are employed for the dual purpose of tensioning the web both laterally and longitudinally. These cords are attached at one end to the border strips and pass upwardly around the outside of the frame as previously described. However, the cords then are threaded through holes in the front end of the web, such as where it is looped over the front end bar 18. The second end of the cords 48 is brought rearwardly, placed under tension, and fastened to the web, binding, or frame. Thus, the front bungee cords 48 tension the web both laterally and longitudinally.

Figure 3:
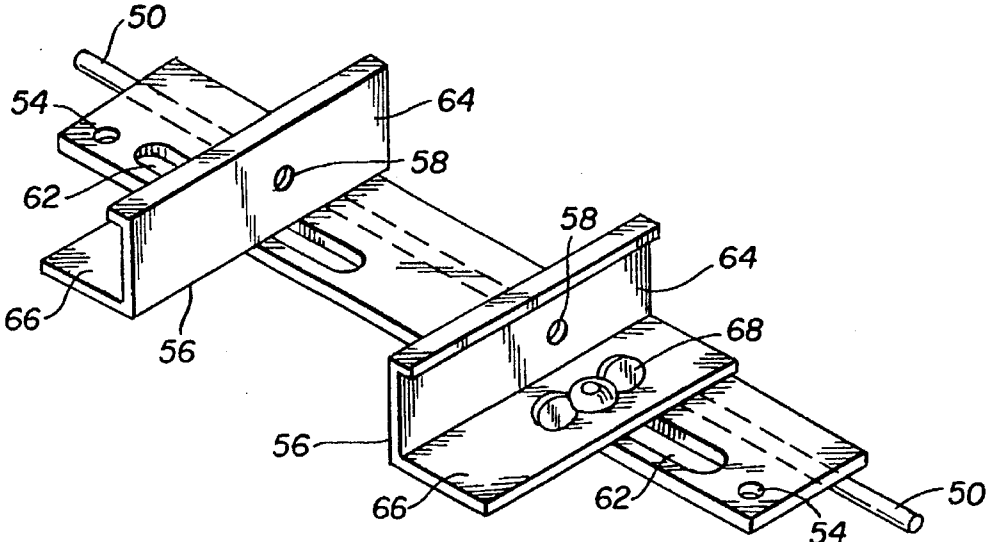
FIG. 3 is an isometric view of the binding.
Figure 4:
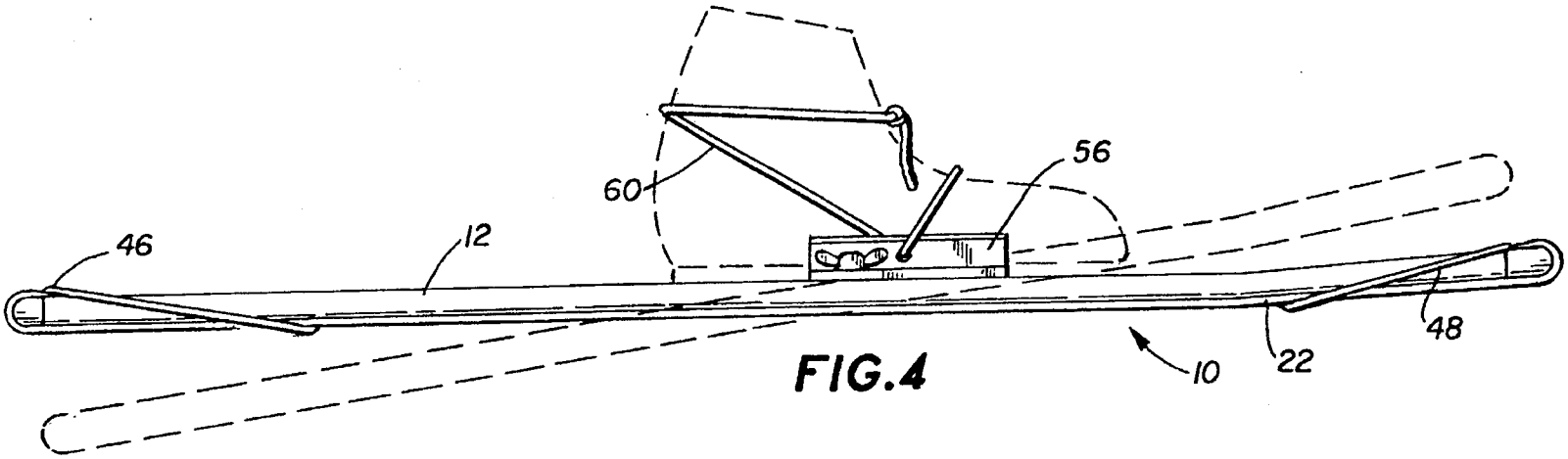
FIG. 4 is a side elevational view of the snowshoe in use with a user's show shown in phantom, and also showing in phantom the resiliently biased position of the snowshoe.

With reference to FIGS. 3 and 4, the binding 24 may serve as an anchor for the front bungee cords 48 and, in turn, use these bungee cords for the further purpose of raising the toe of the snowshoe with respect to the binding during use. The binding is carried by the frame for pivotal movement along a transverse pivot axis. A pivot shaft 50 extends between the opposite side bars of the frame and is disposed along the pivot axis. A convenient way of attaching the binding to the pivot axis is by a base plate 52 carried on the pivot shaft. The base plate can be pivoted on shaft 50, or it can be fixed to the shaft, such as by rivets, and the shaft can be pivoted with respect to the frame. The latter arrangement is preferred. The pivot shaft engages the side bars 16, 18 of the frame in mounting holes formed through the inside face of the frame. Such holes penetrate only the inside faces of the side bars, with the result that the outer walls of the side bars keep shaft 50 centered between the two sides of the snowshoe. These mounting holes are near the rear of front tube 28. When the pivot shaft is installed, it also serves as a spacer, holding the rear of the front tubes 28 at about the same spacing as the front of these tubes. The base plate 52 extends rearwardly from the pivot shaft and carries an attaching means such as holes 54 for attaching the bungee cord 48 or other resilient means to the base.

The base plate 52 of binding 24 carries a pair of longitudinally elongated, lateral foot supports 56. These supports are in laterally spaced apart positions so that a foot or shoe can be received between them. The supports are attached for movement with the base. They define lacing holes 58 that receive a cord 60 that can be used to secure a foot or any sort of shoe to the foot supports, as shown in FIG. 4. Since winter footwear varies in size and style, a means is provided for laterally adjusting the distance between the foot supports on the base. In an example shown in FIG. 3, the rear extension of the base 52 defines elongated, transverse slots 62. Each foot support 56 is formed of an upstanding wall 64 having a mounting flange 66 extending laterally outwardly from its bottom edge. Each mounting flange carries a fastener such as a camlock fastener or screw and wing nut assembly 68 that engages and passes through a slot 62. The fastener is selectively engageable and releasable so that the foot supports can be positioned along the slots as required at variably selected locations. The space between the foot supports can be any selected distance, such as from two to six inches, to accommodate any foot or footwear.

The binding and frame are resiliently biased to urge the toe of the frame to raise with respect to the binding. A resilient member such as a bungee cord is attached between frame and the binding, urging pivotal motion of pivot shaft 50. The resilient member is attached to the frame forwardly of binding pivot axis, and to the base, rearwardly of the pivot axis and over the top of pivot shaft 50. The front attachment may be to either the frame itself or to the web 22 near the front of the frame. The same resilient member can apply longitudinal tension to the web. For example, when the front end of web 22 passes around the forward face of front end bar 18 of the frame, the resilient bungee cord can be attached between the front end of web 22 and binding base 52. The attachment holes 54, located behind the pivot axis, provide an attachment point for the hooks of a bungee cord. In the case of bungee cord 48, previously described, the same bungee cord 48 tensions the web both laterally and longitudinally and lifts the toe of the snowshoe.

When disassembled, the snowshoe is stored in a tight bundle. The longest tube is about one foot in length. The three side tubes forming each side bar, the front and rear end bars and the binding together are only nine rigid pieces. The binding can be folded into a compact shape by pivoting the foot supports 56 at fasteners 68 to align with pivot shaft 50. The bundle of rigid pieces is wrapped by the flexible web. The various bungee cords can be used to secure the bundle. In addition, a storage sack can be used as a convenient holder.

The snowshoe is assembled by piecing together the side bar from the three component tubes. The binding pivot shaft 50 is inserted between the side bars, after which the front and rear end bars are plugged into position. The web is placed across the bottom face of the frame and secured by the bungee cords 46, 48. The front bungee cord 48 is hooked to the rear of the binding base plate 52.

As further shown in FIG. 2, the snowshoe can be assembled almost automatically by threading the tubular bars, or most of the bars, on an elastic cord under tension. For example, the tubular front and side bars are threaded on a cord 70, which has its opposite ends secured to the opposite terminal sections of the snowshoe frame. In the case shown in the drawing, the ends of the cord pass through holes in the side walls of tube sections 32, where the cord ends carry knots 72 that are large enough that they cannot pass back through the holes. The elastic cord is stretchable enough to permit the frame sections to be disassembled and stored in side by side arrangement. At the same time, given the opportunity, the tension of the cord will align the frame sections and, in some cases, pull together the junctions between the sections. Assembly is extremely easy even when the user is wearing mittens, and the cord prevents dropping or loss of frame sections. If desired, the rear tube can be separate from the portions of the frame on the cord, since it will be wrapped with the web 22 and, therefore, is difficult to lose in snow and is simple to handle even with gloved hands.

In use, the user adjusts the foot supports 56 to fit his footwear and ties his foot in place with cord 60. As the user walks on the snowshoe, as the user raises his foot from the ground during each step. The bungee cord 48 is holding the front of the frame and the binding in tension, which raises the front of the frame as shown in phantom in FIG. 4. The raised toe clears the ground as the user's foot moves forward, which greatly aids walking.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

We claim:

1. A collapsible snowshoe, comprising:

an elongated frame having right and left side bars and front and rear end bars;

a web extending between the end bars of the frame;

a shoe binding attached to the frame above said web and between said right and left side bars for pivotal motion along a transverse pivot axis; and a resilient means for urging relative pivotal motion between said shoe binding and said frame along said transverse pivot axis, whereby the front of the frame is urged upwardly with respect to said shoe binding.

2. The collapsible snowshoe of claim 1, wherein each side bar of said elongated frame comprises front, center, and rear tube sections, and the front end bar is longer than the rear end bar, further comprising:

first plug means for connecting the front to the center tube sections;

second plug means for connecting the center to the rear tube sections;

third plug means disposed substantially at a right angle to the front end bar, for connecting the front end bar to the side bars;

fourth plug means disposed substantially at a right angle to the rear end bar, for connecting the rear end bar to the side bars;

wherein, when assembled, the elongated frame is in a flexed condition due to the relatively shorter length of the rear end bar, whereby the frame is rigid.

3. The snowshoe of claim 1, wherein said shoe binding comprises:

a pivot shaft extending between the opposite side bars of the frame and disposed along said pivot axis;

a base carried on said pivot shaft and extending rearwardly therefrom; and an attaching means for attaching said resilient means to said base.

4. The snowshoe of claim 3, wherein said shoe binding further comprises:

a pair of longitudinally elongated foot supports carded on said base in spaced apart positions for, in use, receiving between them a foot and supporting the foot for movement with the base.

5. The snowshoe of claim 4, wherein said foot supports define lacing holes, and said shoe binding further comprises a cord receivable through said lacing holes for, in use, securing a foot to the foot supports.

6. The snowshoe of claim 4, wherein said shoe binding further comprises:

means for laterally adjusting the distance between said foot supports on said base.

7. The snowshoe of claim 4, wherein said foot supports each comprise an upstanding wall having a mounting flange extending laterally outwardly from its base;

said base defines at least one laterally extending, elongated slot; and a selectively engageable and releasable fastener engages each mounting flange and passes through the slot in the base at variably selected locations, thereby variably laterally positioning the foot supports on the base.

8. The snowshoe of claim 3, wherein said resilient means comprises:

an elongated member attached between said frame, forwardly of said shoe binding pivot axis, and to said base, rearwardly of the pivot axis and over the top of said pivot shaft.

9. The snowshoe of claim 3, wherein a front end of said web passes around the forward face of said front end bar of the frame from the bottom side thereof, wherein said resilient means comprises:

an elongated member attached between said front end of the web and said base, rearwardly of the pivot axis and over the top of said pivot shaft.

10. The snowshoe of claim 9, wherein said elongated member is attached at one end to said web near a side edge thereof, extends therefrom below a side bar of the frame, around the outside and back over the top thereof, engages the front end of the web, and extends rearwardly therefrom to said base, whereby the elongated member tensions the web both laterally and longitudinally.

11. The snowshoe of claim 1, further comprising:

means for laterally tensioning said web with respect to said elongated frame.

12. The snowshoe of claim 11, wherein said lateral tensioning means comprises an elongated resilient member attached to an edge of said web, extending from the web below a side bar of the frame, around the outside and back over the top thereof.

* * * * *